US005308028A

United States Patent [19]

Kornberg

[11] Patent Number: 5,308,028

[45] Date of Patent: May 3, 1994

[54] HEADREST SUPPORT FOR A WHEELCHAIR

[76] Inventor: Gary Kornberg, 19 Kathleen Dr. East, Syosset, N.Y. 11791

[21] Appl. No.: 977,555

[22] Filed: Nov. 17, 1992

[51] Int. Cl.[5] ..... B68G 5/00

[52] U.S. Cl. ..... 248/118; 280/304.1; 297/406; 297/409; 297/410

[58] Field of Search ..... 248/118; 297/391, 397, 297/406, 408, 409, 410; 280/250.1, 309.4

[56] References Cited

U.S. PATENT DOCUMENTS

| | | | |
|---|---|---|---|
| 1,471,168 | 10/1923 | Katz | 297/409 X |
| 1,817,755 | 8/1931 | May | 297/409 |
| 3,764,180 | 10/1973 | Mulholland | 297/410 X |
| 4,128,274 | 12/1978 | Schmedemann | 297/391 X |
| 5,011,226 | 4/1991 | Ikeda et al. | 297/391 X |
| 5,074,574 | 12/1991 | Carwin | 297/397 X |

*Primary Examiner*—Ramon O. Ramirez

[57] ABSTRACT

The headrest support for a wheelchair includes a horizontal member with a pair of slide-adjustable clamping blocks that each hold a vertical member. Spacer blocks are provided at the ends of the horizontal member for mounting the headrest support to the back of the chair while allowing the necessary clearance for adjustment of the clamping blocks that lock into position along the horizontal member. A separate locking mechanism on each clamping block provides for independent continuous vertical adjustment of each of the vertical members. Each vertical member supports a forward/rearward member which permits forward/rearward adjustment of a padded occipital support that connects to the forwardmost end of the forward/rearward members. The forward/rearward members also permit adjustment of upward/downward tilt of the occipital support. Selected points of attachment of the forward/rearward members to the occipital support determine the degree of clockwise/counterclockwise rotation and obliquity. These separate adjustments in horizontal, vertical, forward/rearward directions, upward/downward tilt, clockwise/counterclockwise rotation and obliquity, taken together, make possible great precision and versatility in adjustability of the occipital support.

7 Claims, 4 Drawing Sheets

FIGURE # 1
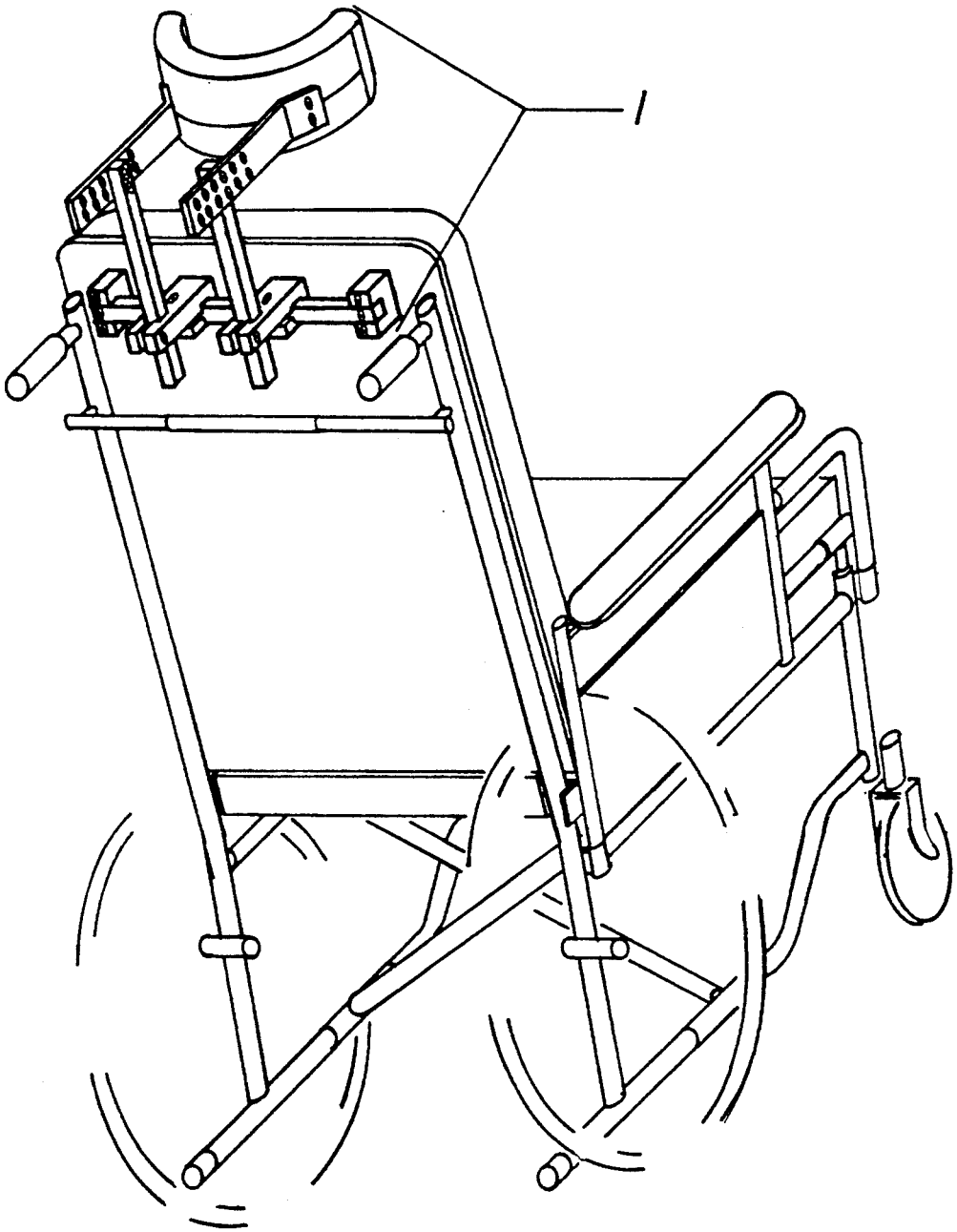

FIGURE #2
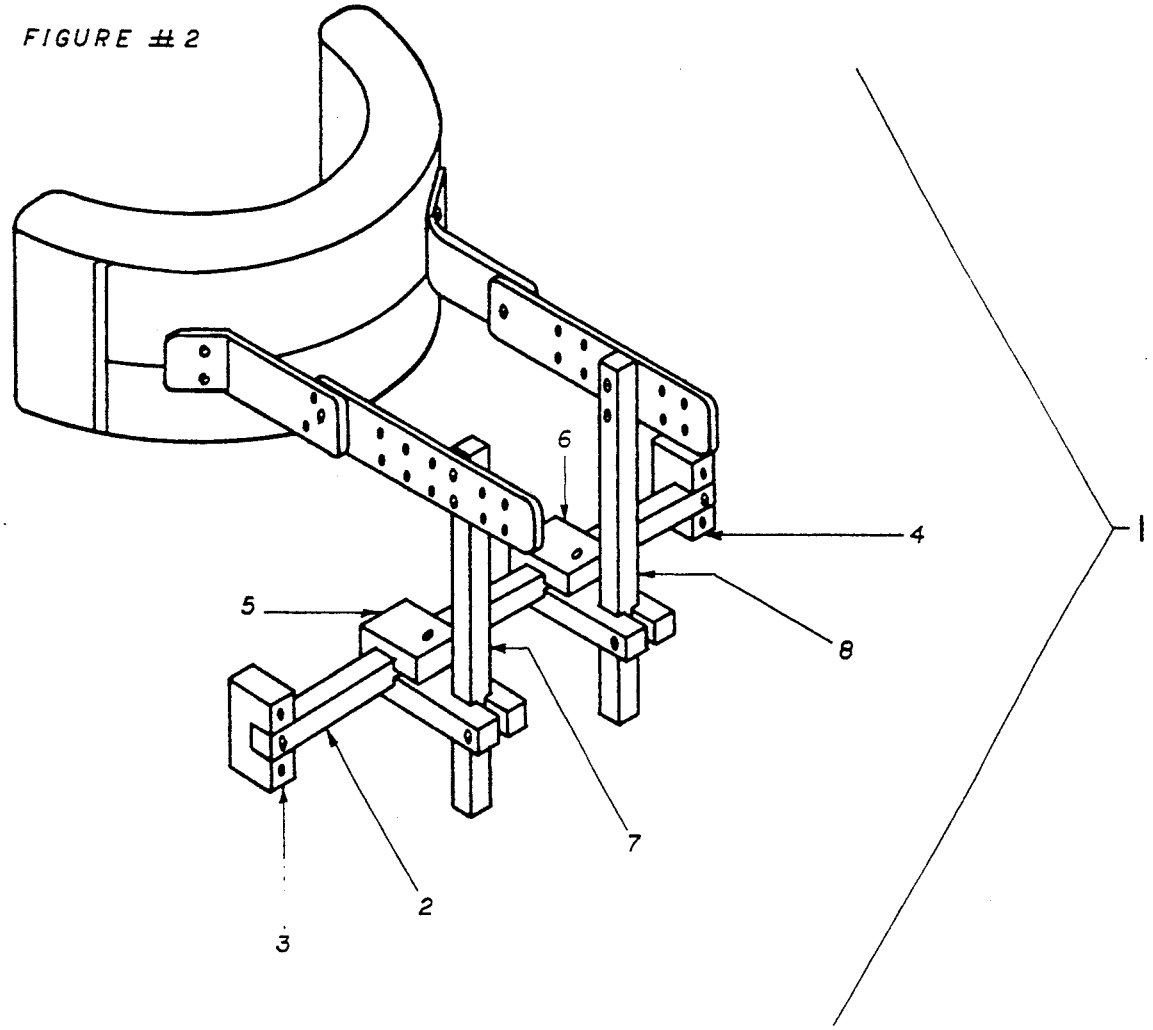

FIGURE # 3
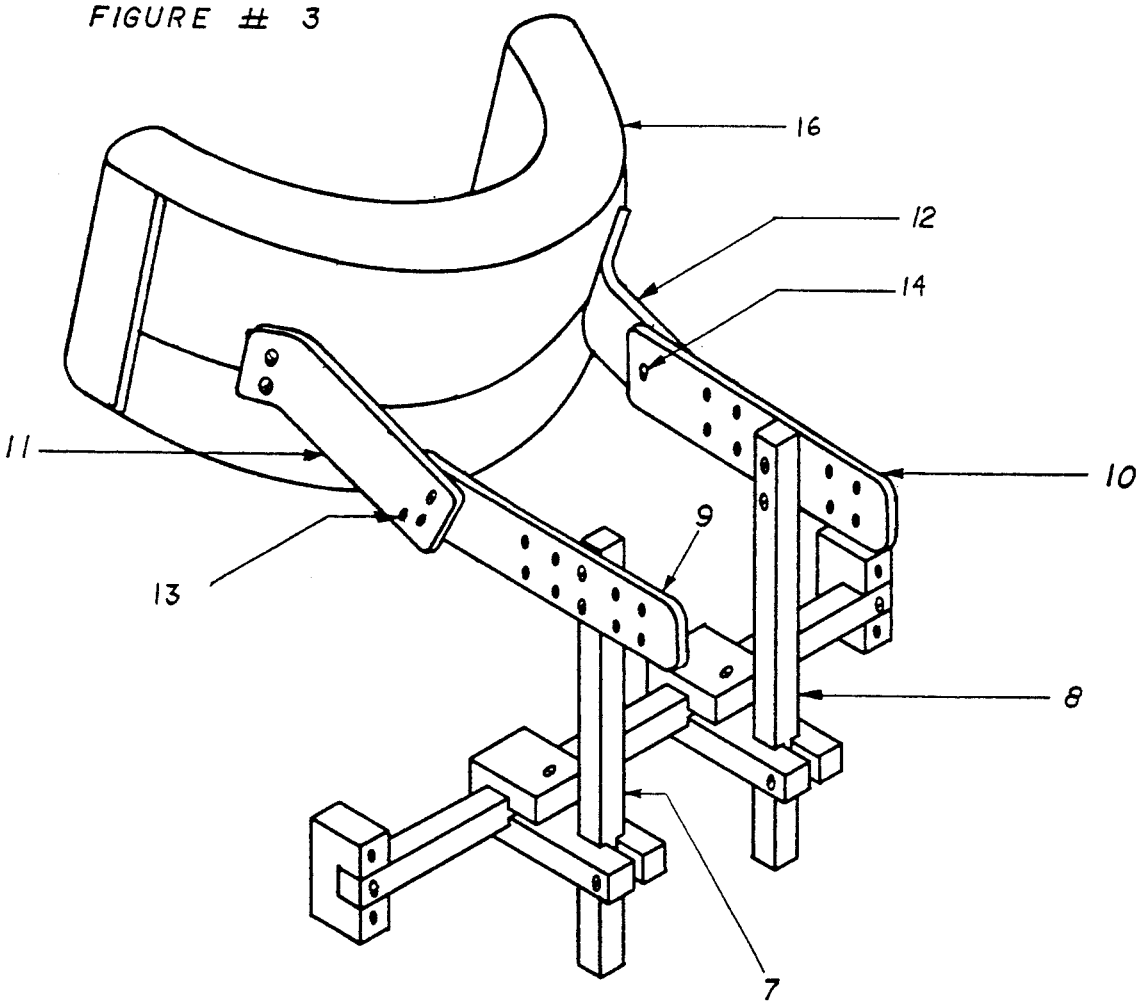

FIGURE # 4
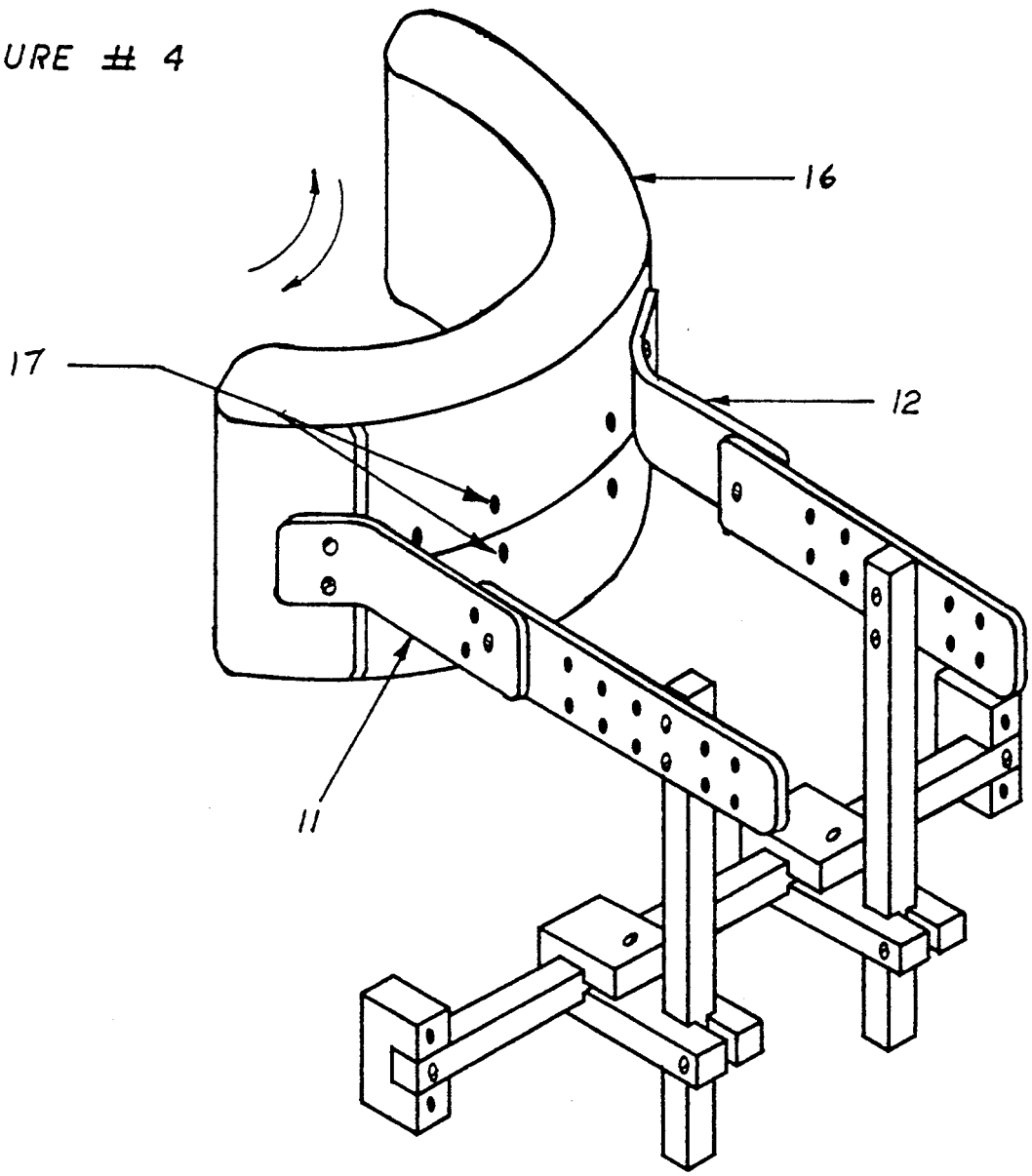

HEADREST SUPPORT FOR A WHEELCHAIR

BACKGROUND OF THE INVENTION

This invention pertains to wheelchairs, and more particularly, to a headrest support for a wheelchair, that can be variously positioned, through a combination of horizontal, vertical, forward/rearward, tilt, rotational adjustments and oblique adjustments.

The utilization of a headrest attachment to a wheelchair offers beneficial support for the back of the head and neck which can extend the amount of time that an individual may remain comfortably seated. In cases where head control is lacking, as in individuals with brain trauma or other neuromuscular dysfunction, the support of a headrest is all the more necessary to stabilize the head and neck. To the degree that the headrest can be adjusted to accommodate the unique dimensions and posture of a given individual, it will provide the maximum benefit.

Existing wheelchair headrests are limited in their capacity to adapt to the more extreme postural dysfunctions that are known to occur. For example, U.S. Pat. No. 5,074,574 shows a headrest which is adjustable in the vertical and forward/rearward directions, only. U.S. Pat. No. 3,764,180 describes a neckrest which is adjustable horizontally, vertically, and which tilts. However, no single headrest was found to offer adjustability in the horizontal, vertical, forward/rearward, tilt, rotational and oblique directions, simultaneously.

It is thus desirable to provide a headrest support system effectively extending the range of adjustability beyond that heretofore available among prior art devices.

OBJECTS AND SUMMARY OF THE INVENTION

In order to surpass the limitations of existing devices, among the several objects of the invention are to offer a novel wheelchair headrest support which is continuously adjustable in both horizontal and vertical planes, adjustable in the forward/rearward dimension in discrete gradations, tiltable up and down, adjustable in its rotation in a clockwise/counterclockwise direction and adjustable obliquely as necessary.

Another object of the invention is the unprecedented refinement in the precision with which it can ultimately be oriented, through the net combination of the aforementioned adjustments, to most nearly achieve the optimal positioning for an individual's unique requirements.

Briefly described, these and other objects and features of the invention, which will be, in part, apparent and, in part, to be further elucidated in that which follows, are accomplished, in one embodiment of the invention, by one horizontal member, having one spacer block affixed to each end. Two vertical members project upward from said horizontal member, and are attached to same, by a mechanism allowing for both horizontal and vertical adjustments. A single axis hinge with a sectioned forward/rearward member extends forward from the top of each of the aforementioned vertical members, with provision made for forward-/rearward adjustment, as well as the degree of upward/downward tilt, the latter being achieved by means of the aforementioned single axis hinges. A padded, curved occipital head support is attached to the two forward/rearward members, the placement of which determine the degree of clockwise/counterclockwise rotation and obliquity.

The entire headrest support mounts to the solid back of a chair, reclining chair, or wheelchair, through the agency of the aforementioned spacer blocks.

The padded, curved occipital head support provides for mid-line orientation when the individual's head rests in the device. This, in turn, maximizes the individual's capacity for forward visual scanning, as well as facilitating breathing and swallowing.

Under this arrangement, the headrest support can be positioned to provide the optimal support of the head and neck of the individual.

This invention, accordingly, comprises the constructions hereinafter described, the scope of the invention being indicated in the claims.

DESCRIPTION OF THE DRAWINGS

In the accompanying drawings,

FIG. 1 is a simplified perspective view of a headrest support incorporating one embodiment of the invention attached to a wheelchair;

FIG. 2 is a simplified perspective view thereof, separated from the wheelchair;

FIG. 3 is a perspective view thereof, illustrating the tiltability of the curved occipital support;

FIG. 4 is a perspective view thereof, illustrating the adjustability in the clockwise/counterclockwise rotation of the curved occipital support.

Corresponding reference characters indicate corresponding parts throughout the several views of the drawings.

DETAILED DESCRIPTION OF THE INVENTION

A headrest support incorporating one embodiment of the invention is generally indicated by the reference number 1 in FIG. 1 which , shows the entire headrest attached to a solid back on a wheelchair.

As illustrated in FIG. 2, the headrest support 1 includes one horizontal member 2 flanked by one spacer block 3, 4 on each end, by which the entire headrest support can be mounted on the solid back of a chair, reclining chair, or wheelchair. Simultaneously, said spacer blocks 3, 4 also provide the necessary clearance for the operation of the two slide-adjustable clamping blocks 5, 6 each of which locks into position, thereby allowing for continuous lateral adjustment of the two vertical members 7, 8 that project upward, one from each block 5, 6 perpendicular to the aforementioned horizontal member 2, the heights of which are independently continuously adjustable through the mechanism of the slide-adjustable clamping blocks 5, 6.

The slide-adjustable clamping blocks simultaneously accomplish two functions of providing for adjustment of said vertical members along said horizontal member and providing for height adjustment of said vertical members.

Each of the two vertical members 7, 8, in turn, support a discretely adjustable forward/rearward member 9, 10, as shown in FIG. 3. Each forward/rearward member is sectioned, the pairs of sections 9, 11 and 10, 12 joining at selected pivots. The resulting single axis hinges 13, 14 allow for continuous adjustment of the upward/downward tilt of the padded, curved occipital support 16 which is attached at its rear to the forwardmost ends of the two aforementioned forward/rearward members 11, 12, thereby accommodating the range of cervical flexion/extension.

Adjustment of the degree of clockwise/counterclockwise rotation and obliquity of the occipital support 16 is accomplished through the selection of the points 17 at which the occipital support 16 is attached to the forward/rearward members 11, 12, as indicated in FIG. 4.

Some advantages of the invention evident from the foregoing description include a headrest support for a wheelchair that is simultaneously horizontally adjustable, vertically adjustable, forward/rearward adjustable, tilt adjustable, rotationally adjustable and obliquely adjustable.

The resultant versatility in adjustability facilitates precise positioning of the occipital support, thus enhancing posture, and thereby optimizing the level of comfort and support achievable for the individual. Similarly, there is an enhanced potential to accommodate the widest range of individual needs.

In view of the above, it will be seen that the several objects of the invention are achieved and other advantageous results attained.

As various changes can be made in the above constructions without departing from the scope of the invention, it is intended that all matter contained in the above description or shown in the accompanying drawings shall be interpreted as illustrative and not in a limiting sense.

What is claimed is:

1. A headrest support for a wheelchair comprising:

a) a horizontal member having opposite ends, b) a pair of spacer blocks, one affixed to each end of said horizontal member, c) a pair of slide-adjustable clamping blocks which slide along said horizontal member having means for locking said clamping blocks at a selected position along said horizontal member, d) a pair of vertical members, slidable up and down through said slide-adjustable clamping blocks, said clamping blocks having means for locking said vertical members in a desired position providing for independent height adjustment of said vertical members, e) a pair of sectioned forward/rearward members, each projecting forward from the top of each of said vertical members, each formed by tow sections joined by a locking hinge providing tilt adjustment between the sections, and f) a padded, curved occipital support attached to the forward-most end of each of said forward/rearward members.

2. The headrest support as claimed in claim 1 wherein said spacer blocks provide the means for attachment to the solid back of a chair, reclining chair, or wheelchair.

3. The headrest support as claimed in claim 1 wherein said spacer blocks simultaneously provide the necessary clearance for the operation of said slide-adjustable clamping blocks along said horizontal member.

4. The headrest support as claimed in claim 1 wherein said horizontal members and said vertical members have a rectangular cross-section and said slide-adjustable clamping blocks are formed to engage the rectangular shape of the horizontal and vertical members to preclude the effects of torque on said horizontal and vertical members.

5. The headrest support as claimed in claim 1 wherein the forward/rearward members are secured to the vertical members by a plurality of openings and fastening means, the openings being located on the forward/rearward members providing aft and fore adjustment with respect to the vertical members.

6. The headrest support as claimed in claim 1 wherein the forward-most ends of each of said forward/rearward members are attached to the back of the padded, curved occipital support by a plurality of openings and fastening means, the openings being located on the occipital support providing the rotational adjustment with respect to the forward/rearward members.

7. A headrest support for a wheelchair comprising;

a) a horizontal member having opposite ends, b) a pair of spacer blocks, one affixed to each end of said horizontal member, c) a pair of slide-adjustable clamping blocks which slide along said horizontal member having means for locking said clamping blocks at a selected position along said horizontal member, d) a pair of vertical members, slidable up and down through said slide-adjustable clamping blocks, said clamping blocks having means for locking said vertical members in a desired position providing for independent height adjustment of said vertical members, e) a pair of forward/rearward connecting means, each projecting forward from the top of each of said vertical members, and f) a padded, curved occipital support attached to the forward-most end of each of said forward/rearward connecting means.

* * * * *